United States Patent [19]

Graham et al.

[11] Patent Number: 4,929,099

[45] Date of Patent: May 29, 1990

[54] MULTI-LINE SERIAL PRINTER

[75] Inventors: Scott M. Graham; Kenneth R. Ewing, both of Fremont; Marshall H. Trackman, San Leandro; Duane R. Darr, San Jose, all of Calif.

[73] Assignee: Qume Corporation, San Jose, Calif.

[21] Appl. No.: 145,272

[22] Filed: Jan. 19, 1988

[51] Int. Cl.[5] ..... B41J 3/02

[52] U.S. Cl. ..... 400/76; 400/61; 400/121

[58] Field of Search ..... 364/900, 518, 519; 400/121, 124, 76, 61

[56] References Cited

U.S. PATENT DOCUMENTS

| | | | |
|---|---|---|---|
| 3,938,641 | 2/1976 | Fulton | 400/124 X |
| 3,990,559 | 11/1976 | Martin | 400/124 |
| 4,103,066 | 7/1978 | Brooks et al. | 428/337 |
| 4,345,845 | 8/1982 | Bohnhoff et al. | 400/120 |
| 4,400,100 | 8/1983 | Aviram et al. | 400/120 |
| 4,539,653 | 9/1985 | Bartlett | 364/900 |
| 4,627,749 | 12/1986 | Meo | 400/121 |
| 4,655,622 | 4/1987 | Aoki | 400/121 |
| 4,660,029 | 4/1987 | Houda et al. | 340/744 |
| 4,674,895 | 6/1987 | Tanaka | 400/121 |
| 4,707,153 | 11/1987 | Nishi | 400/76 X |
| 4,740,092 | 4/1988 | Applegate et al. | 400/53 |

FOREIGN PATENT DOCUMENTS

| | | | |
|---|---|---|---|
| 0031421 | 7/1981 | European Pat. Off. | 400/121 |
| 109765 | 8/1981 | Japan | 400/124 |

OTHER PUBLICATIONS

*IBM Tech. Disc. Bulletin,* by R. E. Pence, vol. 21, No. 12, May 1979, p. 4892, 400-121.

IBM Journal of Research and Development, vol. 29, No. 5, Sep. 1985 pp. 442–477; 494–542.

*Primary Examiner*—Paul T. Sewell

*Attorney, Agent, or Firm*—Christie, Parker & Hale

[57] ABSTRACT

A predetermined window height at least three times the height of the normal printed characters can be printed in a single horizontal sweep of the printhead across the page. A page of character oriented data is first sorted vertically; the data is then sequentially processed into a "print window" of horizontally sorted characters until a character is reached that will not fit within the current print window. The symbolic data in the print window is converted into bit mapped image data only slightly in advance of the current printhead position. The average throughout is increased by permitting the velocity of the printhead to vary as a function of the complexity of the image formation process. For a thermal process, this is accompanied by an appropriate adjustment in the current passing through the activated printhead electrodes. The vertical positioning of the pixels within the print window is varied to better distribute head wear.

4 Claims, 6 Drawing Sheets

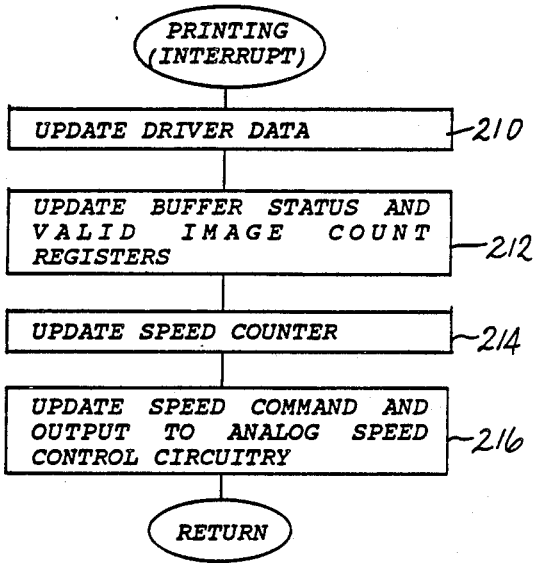
FIG. 8
FIG. 4
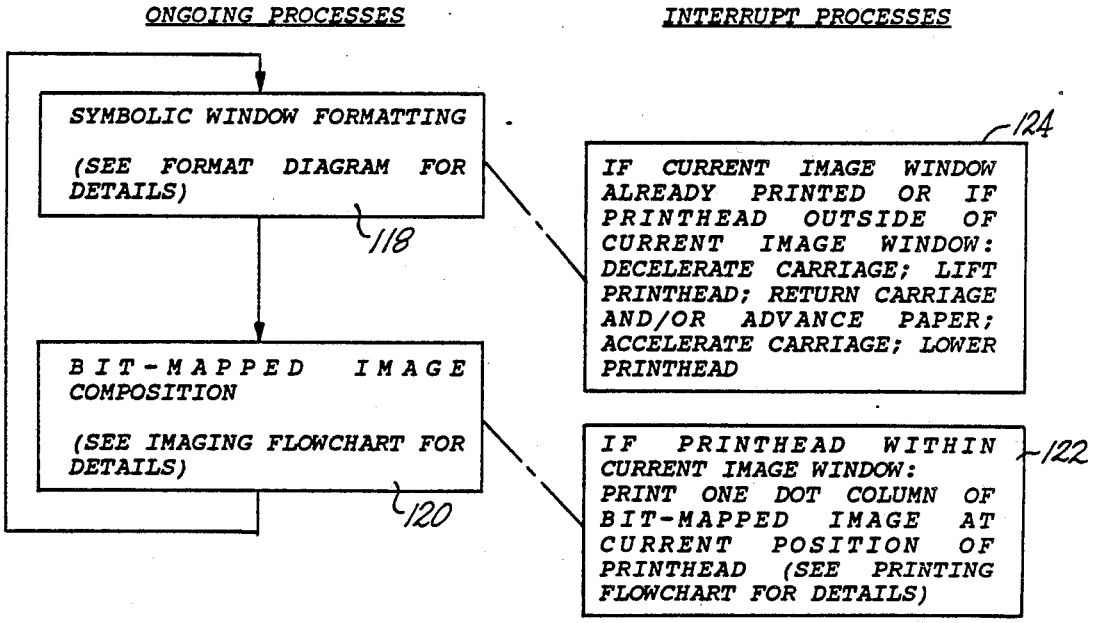

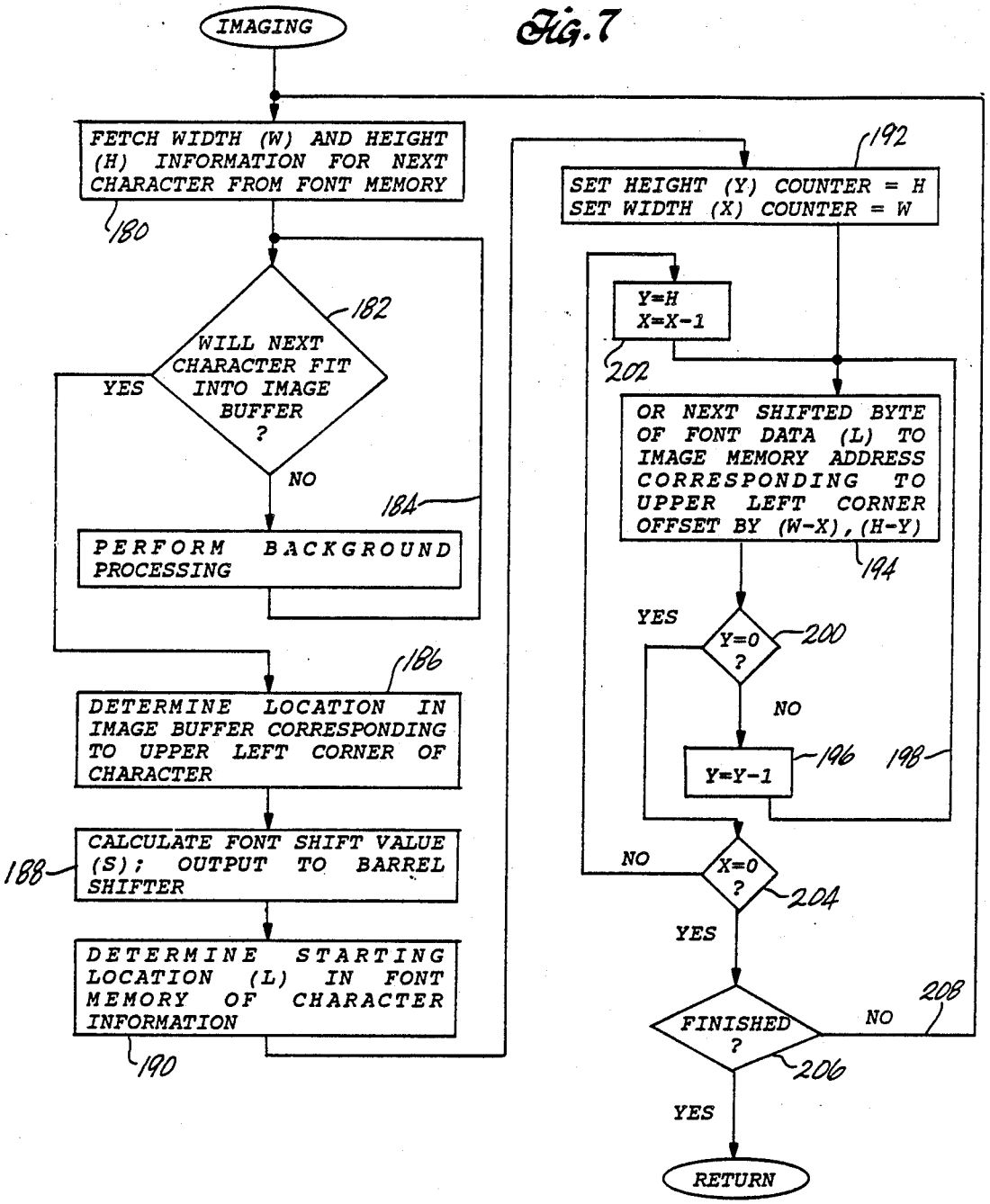
Fig. 7
IMAGING
FETCH WIDTH (W) AND HEIGHT (H) INFORMATION FOR NEXT CHARACTER FROM FONT MEMORY
180
WILL NEXT CHARACTER FIT INTO IMAGE BUFFER ?
182
YES
NO
PERFORM BACKGROUND PROCESSING
184
DETERMINE LOCATION IN IMAGE BUFFER CORRESPONDING TO UPPER LEFT CORNER OF CHARACTER
186
CALCULATE FONT SHIFT VALUE (S); OUTPUT TO BARREL SHIFTER
188
DETERMINE STARTING LOCATION (L) IN FONT MEMORY OF CHARACTER INFORMATION
190
SET HEIGHT (Y) COUNTER = H
SET WIDTH (X) COUNTER = W
192
Y=H
X=X-1
202
OR NEXT SHIFTED BYTE OF FONT DATA (L) TO IMAGE MEMORY ADDRESS CORRESPONDING TO UPPER LEFT CORNER OFFSET BY (W-X),(H-Y)
194
YES
Y=0 ?
200
NO
Y=Y-1
196
198
NO
X=0 ?
204
YES
FINISHED ?
206
NO
208
YES
RETURN

MULTI-LINE SERIAL PRINTER

TECHNICAL FIELD

The present invention relates to a system for printing characters each comprising a matrix of individual picture elements (pixels), and more particularly to a printer having a printhead that prints a series of vertical pixel arrays as the printhead is driven horizontally across a portion of a standard size page.

BACKGROUND ART

IBM corporation has marketed several models of resistive ribbon thermal transfer printers under the trademark Quietwriter which print a single line of "letter quality" characters (i.e., with a minimum vertical resolution of 240 vertical pixels per inch (25.4 mm) and a minimum horizontal resolution of 360 pixels per inch (25.4 mm)) as a printhead is driven horizontally across the page at a constant speed. The printhead is provided with 40 electrodes arranged one above another in a vertical row. A special thermal transfer resistive ribbon having a resistive layer, a conductive layer, an ink release layer and an ink layer is positioned between the printhead and the paper (or other image carrier) on which the characters are to be printed, with the resistive layer in contact with the printhead and the ink layer in contact with the paper. Each electrode may be selectively activated and when activated causes a localized current to flow through the resistive layer to the conductive layer (which is grounded) thereby heating a small area of the ink layer in its immediate vicinity and causing a dot of ink to be released from the ribbon onto the image carrier. For best print quality, the thermal transfer ribbon should remain stationary with respect to the paper as the current is applied, and should be rapidly peeled away shortly thereafter at a predetermined angle between the ribbon and the printhead; the ribbon motion must be synchronized with the movement of the printhead. Accordingly, it is therefore conventional to print in only one direction, resulting in an interruption of printing whenever the printhead is being returned from the end of one line to the start of the next line. In the prior art printers used with the resistive ribbon thermal transfer process, only one line of characters is printed during a single pass of the printhead over the ribbon and the thus-used portion of the ribbon cannot be reused; fractions and other formulas occupying more than a single line and text employing subscripted and superscripted characters slightly below or above the printline are printed in several passes. Furthermore, because certain electrodes are used more than others, the high currents used in the process cause a differential erosion of the printhead electrodes, so that after a period of use the printhead no longer makes the required uniform ohmic contact with the resistive layer and no longer provides a uniform pressure on the ink layer as it is being released onto the paper.

The printhead, print ribbon, drive electronics and other major components for such a printer, including many process considerations, are described in detail in pages 443–477 and 494–538 of the IBM Journal of Research and Development Vol 29, Number 5, dated September 1985, and in U.S. Pat. Nos. 4,103,066 ("Ribbon Substrate"); 4,345,845 ("Drive Electronics"); 4,350,499 ("Resistive Ribbon Printing Apparatus and Method"); 4,400,100 ("Ribbon Layers"); and 4,456,915 ("Print Head"), which are hereby incorporated by reference.

It is to be noted that, although the thermal transfer resistive ribbon process produces printing of high quality, the prior art printers designed for use with that process are relatively slow and wasteful of expensive supplies.

A dot matrix printer capable of printing more than a single line of fixed height draft quality characters in a single horizontal sweep of the printhead is known from published European Patent Application No. A2 0 031 421 in the name of IBM and entitled MULTIPLE MODE PRINTING SYSTEM AND METHOD. Such a prior art printer is clearly unsuitable for use with the above described thermal transfer resistive ribbon process.

DISCLOSURE OF INVENTION

Accordingly, it is an overall objective of the present invention to provide a fast, efficient, high quality character oriented printer that can be built at a relatively low cost.

It is a related object to provide a printer that is capable of printing a letter quality document at a relatively high throughput rate and that makes optimum use of printer ribbon and other expendable supplies.

It is another related object to provide a fast, efficient printer that is compatible with the thermal transfer resistive ribbon process.

It is a more specific object to provide a serial printer that can compose and print several lines of characters simultaneously.

It is a related object to provide a serial printer suitable for use with a unidirectional printing process that eliminates the requirement for a carriage return after every line, thereby further increasing average throughput.

It is another more specific object to provide a printer that is capable of printing different height characters, complex formulas, and raised and lowered characters (such as subscripts and superscripts) in a single pass, thereby making the most efficient use of the ribbon and printhead.

It is yet another specific object to provide a printer that makes optimum use of a ribbon and a printhead having a vertical dimension large enough to print three lines of normally spaced standard sized characters in a single pass.

In accordance with one aspect of the present invention, a predetermined window height (somewhat less than the nominal width of the print ribbon but at least three times the height of the normal printed characters) corresponds to the maximum vertical print dimension that can be printed in a single horizontal sweep of the printhead across the page. A page of character oriented data is first processed by sorting the data representative of the characters to be printed and their relative locations with respect to a page to be printed into a first ordered list (hereinafter referred to as the page list) ordered by the vertical position of each character (or sequence of characters) relative to an index position on the page; the data in the page list is then sequentially processed into a second ordered list of characters (hereinafter referred to as the window list) sorted by the horizontal distance from a horizontal index position on the page to the start of each character, until a first out-of-range character is reached in the page list that does not fit within the predetermined print window. The characters in the window list are then printed and the window list is reinitialized and the process repeated starting at the most recently processed out-of-range character until the last character in the page list has been entered into the window list and printed. In the preferred embodiment, the printhead is a ½" (13 mm) high vertical row of 120 dot-shaped electrodes and the individual characters comprise a matrix of such dots which are formed as the printhead passes horizontally over a print ribbon overlaying the paper or other image carrier; the data matrices defining the characters for a particular font are stored in a font cartridge or other memory device. The character data is converted into a corresponding sequence of horizontally spaced arrays of vertical dots only slightly in advance of the printhead arriving at the location where the dots are to be printed on the page. This results in a simple but versatile printer architecture which is capable of printing many different sizes and combinations of print characters with optimum utilization of the print ribbon.

In accordance with another important aspect of the present invention, the average throughput is increased and the maximum throughput consistent with optimum print quality is obtained by permitting the velocity of the printhead to vary during the printing operation as a function of the complexity of the image formation process, since it takes more time to convert a given area containing many densely spaced characters into an image array of individual pixels than the same size area containing only a few widely spaced characters.

Because of the sensitivity of the resistive ribbon thermal transfer printing process to variations in speed and temperature, any such variation in printhead velocity during printing will require appropriate adjustment in the current passing through the activated printhead electrodes.

In a preferred embodiment, the adjustments to the printhead velocity are made in accordance with a predetermined algorithm implemented by a microprocessor operating under the control of a firmware program; the required adjustments to the printhead current are made by an analog circuit whose output is proportional to the squareroot of the actual printhead velocity as measured by an encoder on the motor driving the carriage. In addition, another analog circuit provides an adjustment proportional to resistive losses in the print ribbon between the printhead and ground.

In accordance with another aspect of the invention, throughput is increased, double pass printing may be drastically reduced, and ribbon usage is minimized, by pre-imaging the image data (which may include overstrikes, bolding (shadow printing), kerning, underlines, subscripts, and superscripts) in a horizontally sorted multi-line window buffer. The printhead is located at a vertical position relative to the window to be printed so that all the data in the print window can be printed in a single horizontal pass. This is achieved in an exemplary embodiment by initializing the upper left corner position of the window at the upper left corner of the first character entered into the window list, and then moving the corner up or to the left as additional characters which are higher or to the left of the current corner position are appended (linked) to the horizontally sorted window list.

In accordance with yet another aspect of the invention, whenever a print window list to be printed in a particular printing pass does not contain any characters that extend to the very bottom of the window, and thus it will not be necessary to use both the uppermost and lowermost electrodes on the printhead during the next printing pass, the vertical position of the printhead relative to the upper corner of the print window is varied to more evenly distribute the erosion effects that occur as current flows through the different electrodes used to print the individual dots comprising the various characters.

BRIEF DESCRIPTION OF DRAWINGS

For a better understanding of how the invention may best be practiced, reference should be made to the following detailed description of a exemplary printer embodying the presently contemplated best mode for carrying out the invention and to the appended drawings in which:

FIG. 4 is a state diagram showing the temporal relationship of the various digital processes involved in composing and printing character data;

FIGS. 5*a* and 5*b* show the formats of the window list data and of the font data, respectively;

FIG. 7 is a flow chart diagram showing the processing steps used to compose bit-mapped image data in an image buffer from the data in the symbolic window list;

FIG. 8 is a flow chart diagram showing the processing steps used to print the image data in the image buffer.

BEST MODE FOR CARRYING OUT THE INVENTION

1. Mechanical Layout

Figure 1:
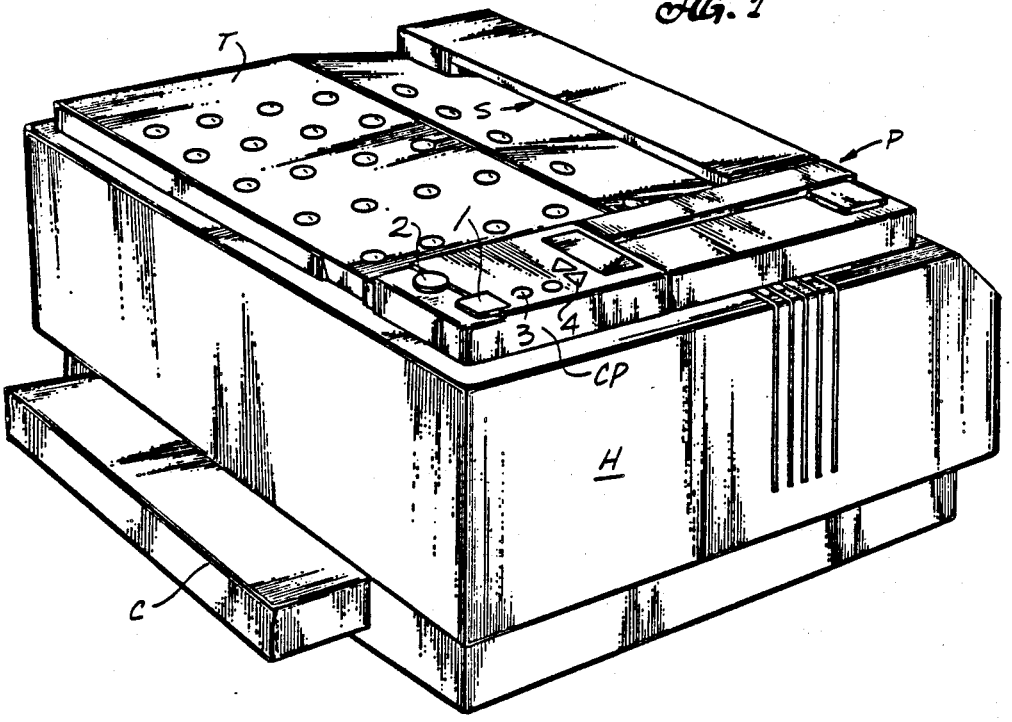
FIG. 1 is an isometric view of an exemplary printer embodying the invention as it appears to the user.
Figure 2:
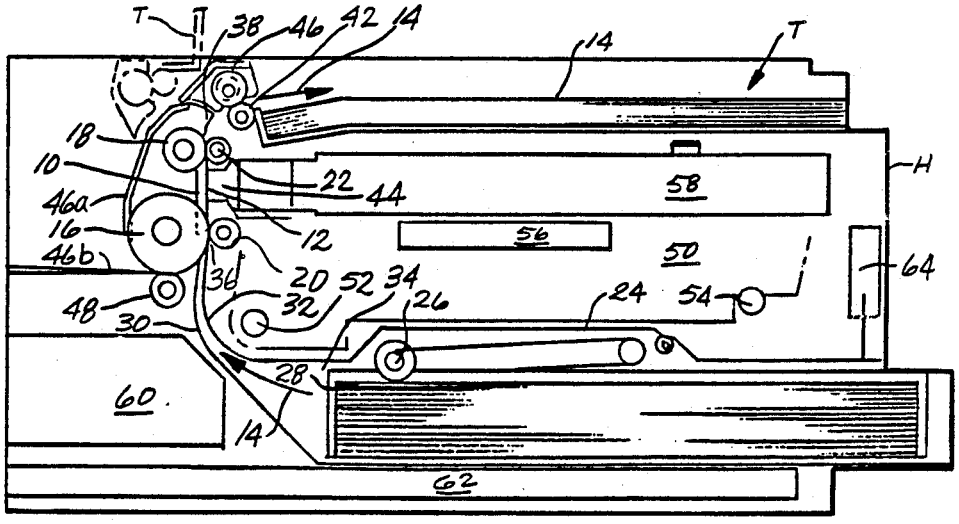
FIG. 2 is a cut-away end elevational view of the printer of FIG. 1 showing its principal mechanical components.

Referring now to FIGS. 1 and 2, which are respectively an isometric and a cut-away end elevational view of a printer embodying the present invention showing its principal subsystems and many of its mechanical components, including its user interface, it will be seen that the printer P comprises a housing H, a paper cassette C, and an output tray T adjacent to an output slot S from which the printed sheets emerge face down in collated sequence. A conventional user control panel CP may provide the user with pressure operated switches 1, 2, 3 with which to program and control the printer, and a liquid crystal message display 4 used for displaying both program options and status messages.

A flat platen 10 (FIG. 2) provides a rubberized vertical surface 12 against which the rear surface of an image carrier 14 (typically a sheet of vertically oriented letter sized paper capable of accommodating 66 lines of 85 10-pitch size characters, although the presently preferred embodiment will accommodate a variety of paper sizes in both vertical and horizontal orientations) is positioned for printing. In order to permit printing at different vertical positions on the page and at the same time ensure that the paper is accurately positioned and buckle free, it is gripped between a relatively large diameter meter roller 16 having a high friction surface (e.g., a thin layer of rubber) and a relatively small diameter overdrive roller 18 have a low friction surface (e.g., polished stainless steel). Both rollers 16, 18 are driven from a stepper motor by means of a cogged belt (not shown); the surface speed of the overdrive roller 18 is approximately 2% higher than that of the meter roller 16. A pair of free-turning tension rollers 20, 22 press the paper against the meter roller 16 and overdrive roller 18 respectively. In order to accommodate paper of varying widths, it has been found advantageous to design each tension roller assembly 20, 22 in the form of a number of short rollers asymmetrically arranged on a common shaft, with the tension force being applied to at least one central point of the shaft in addition to its ends to thereby provide an equal distribution of force regardless of the width of the paper or other image carrier being used. In order to provide fine vertical registrational accuracy, the basic increment of vertical paper movement (1/120" (0.2 mm) or two pixels) corresponds to one step of the motor and the diameters of the meter roller 16 and of the overdrive roller 18 are both maintained to a high tolerance. Two paper paths are provided: a normal path from a paper cassette C provided with a conventional paper separator mechanism 24 comprising a motorized feed roller 26 (preferably integral with the printer and separate from the cassette) and a pair of corner sheet separators 28. Opposed curved paper guides 30, 32 lead from the exit point 34 of the cassette C to the nip 36 between the feed meter roller 16 and its tension roller 20. An output guide 38 leads to a pair of output rollers 40, 42 which eject the printed page into an output tray T. Since the printhead 44 is located between paper cassette C and output tray T and since the paper is directed back over the printhead 44, the printed pages are ejected face down in collated order.

A second paper path for manual input is provided by a second pair of paper guides **46*a*, 46*b*, which lead to a third tension roller 48, also in contact with meter roller 16, which cooperates with the upper portions of guides 30, 32 to feed a single piece of paper into the nip 36 between meter roller 16 and first tension roller 20**.

Printhead 44 is mounted to a carriage 50 which is slidably mounted on a pair of rails 52, 54. The printhead 44 comprises 120 electrodes arranged in a vertical printhead array, each electrode being connected by a respective conductor of a flexible flat cable to its respective driver of a printhead driver circuit board 56 also mounted on the carriage 50. Also mounted on carriage 50 is a ribbon cassette 58 which contains a supply of ribbon sufficiently wide (16.2 mm) to print three lines of standard spaced typewriter size print simultaneously, and sufficiently long (395 m) to print 200 sheets of normal printed output.

Not visible in FIG. 1 is the carriage dc servo motor M (see FIG. 9) which drives the carriage 50 by means of a cogged belt and which is equipped with an optical encoder E to provide the logic board electronics 62 with information as to the current position and velocity of the carriage. The ribbon feed mechanism consists of a pair of pinch rollers driven through a clutch which is actuated only when printing from a wheel that is caused to rotate as the carriage 50 slides on its rails (thereby ensuring that the ribbon is advanced in synchronization with the movement of the printhead 44 and at the same time avoiding unecessary expenditure of ribbon if several print colums in the print window are blank (e.g. when printing tabular data). Also omitted from FIG. 1 are the motive power (preferably small dc motors) for taking up the expended ribbon and for moving the printhead 44 into and out of contact with the ribbon. Also contained within the printer housing H is a power supply 60, a logic board 62, and provision for two optional font cartridges 64.

In order to permit convenient access to the ribbon cassette 58 and to the font cartridges 64, the output tray T (which also functions as the top of housing H) can be swung up to the position T' indicated in dashed line. Similarly, a hinged access door is provided in the vicinity of feed roller 26 and paper guides 30, 32.

2. Process Overview

Before the specifics of the circuits which comprise printer logic board 62 and the other printer electronics are reviewed in detail, it will be beneficial to consider the image composition process that needs to be performed by a character oriented printer in response to a sequence of data specifying the individual characters to be printed generated by a host computer. The data from the host computer (which may be in standard ASCII format, but which also may be in any other convenient format for communicating data from a host computer to a printer) also defines the position of each character on the page, either implicitly (by means of margin settings, tab settings, line spacing settings, pitch settings, carriage returns) and/or explicitly (by means of relative or absolute vertical and horizontal motion commands), and may also define the size and shape of each character (normally by referring to a set of previously stored font data) and possible variations to the standard font characters (such as underline, overstrike, shadow, expanded, etc.). The printer logic unit 62 must first convert this data into image data consisting of individual dots (pixels) at defined locations on the page, and then into motion commands to move the paper and the printhead, with which are synchronized controlled pulses of current through the individual electrodes of the printhead. It is important to the present invention that this data conversion process be performed in a way that results in optimized motion commands resulting in maximized throughput, minimized ribbon usage and optimal utilization of processing resources. To that end, the printhead speed varies in accordance with the amount of already composed bit-mapped image data, and the voltage at the printhead electrodes is varied in accordance with the measured speed of the head.

3. Digital Processing 3.1. Preprocessing of Input Data

Figure 3:
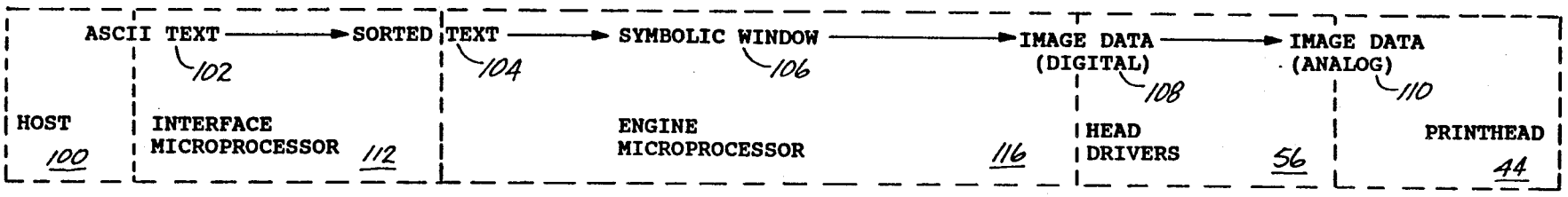
FIG. 3 is a data flow diagram showing how character data and image data flows between the digital and analog electronic subsystems.

Reference should now be made to FIG. 3 which shows the flow of data from the host (typically page oriented ASCII text 102), to vertically sorted lines of text 104, to a horizontally sorted symbolic window 106, to digital image data 108, and finally to the individual channels of analog power signals 110 that drive the individual electrodes on the printhead.

To that end, the input data 102 for a single page of characters is first formatted by an interface microprocessor 112 (Intel model 80188 in the exemplary embodiment being described) as a set 104 of vertical lists each corresponding to a line or partial line of characters associated with a particular font and an initial printline horizontal position and vertical position. The individual lists of thus-normalized data are ordered by the vertical position associated with each individual list. The vertical reference may be the writing line or any other arbitrary baseline position referenced in the font definition. At this point in the process, it is not necessary to know the height of each individual character or even (for proportional spaced characters) the horizontal spacing from one character to the next; thus the interface processor 112 need not have access to the font data 114 in order to perform the required sorting. In an exemplary embodiment, the interface microprocessor 112 may also provide the required communication link to the user control panel CP. The interface microprocessor converts the printing commands to crosshair positions on the page where each character is to print and sends them with the character code to the engine.

3.2. Image Composition

Having thus converted the incoming character data and other commands 102 from the host computer into a formatted page 104 of normalized data representing the entire printed page, the formatted page data is then passed to an engine microprocessor 116 (in the exemplary embodiment being described, an Intel 8085) which accesses the identified font data and performs two interrelated ongoing image generation functions. As shown symbolically in the state diagram of FIG. 4, the engine 116 alternated between the symbolic window formatting process 118 and the bit-mapped image composition process 120. While composing the bit-mapped image (which is stored in a circular buffer that can accommodate only 1.4" (36 mm) of image data), the engine responds (block 122) to interrupts generated as the carriage carrying the printhead moves across the page by printing the corresponding column of image data, thereby freeing the space in the image buffer for new image data. Similarly, the formation of a window of symbolic data 120 is performed during interrupt driven carriage return and paper feed operations 124.

A print window is first established whose upper left hand corner is initially set at the upper left corner of the first character in the first vertical list. The height of the print window is determined by the width of the print ribbon and preferably is sufficient to accommodate three lines of standard single spaced text; in an exemplary embodiment, standard text is vertically spaced six lines to the inch (25.4 mm) and the maximum size of a standard character (a single character cell of a standard character font) is 1/6" high×1/10" wide (4.2×2.5 mm); the ribbon width is 0.64" (16.2 mm), i.e., 28% higher than three such character cells, thereby providing added strength at the upper and lower edges of the ribbon.

The first vertical list of text 104 from interface microprocessor 112 is sequentially processed by reference to the particular font associated with the list and starting position to which it relates. The upper left hand corner of the window is adjusted whenever necessary to accommodate a newly added character that is taller (character height is included in the font data) or positioned further to the left than any previously processed character. Similarly, the lower right hand corner of the symbolic character window may be extended downward (for a newly added character extending below the current lower boundary of the window) or to the right. As characters are added, they are linked forwards and backwards to the other characters in the list in accordance with the horizonal positions of their respective left edges (calculated from the current character's crosshair position and the centerline offset data contained in the font data associated with the current vertical list). This process is then repeated for subsequent character data in the current vertical list and for subsequent vertical lists in the formatted page data created by the interface microprocessor until either the end of the page is reached or a character is reached which would force the lower boundary of the print window to be extended more than ½" (13 mm) below the current top boundary. In any event, a previously processed character will never extend above the window's most recent upper boundary (since the top of the window is never lowered); similarly, it will never extend below the most recent lower boundary. At the same time the window of symbolic data is being composed, it is advantageous to test for possible vertical juxtapositions of characters that could cause ribbon breakage. Head wear can be made more uniform (thereby resulting in better print quality and longer head life) by randomizing the top of the window relative to the top electrode on the printhead when converting the vertical position data from page coordinates to window coordinates.

The image composition process is hereinafter described in more detail with particular reference to the flowcharts of FIGS. 6 and 7 and to the data structure diagram of FIG. 5, comprising FIG. 5*a* and FIG. 5*b*.

3.3. Digital Printing Functions

The image composition process uses the font character address to locate the data specifying what positions in the character matrix are to be filled in with inked dots and ORing this information at the position of the image buffer corresponding to the vertical and horizontal position of the character on the printed page with respect to the relative position of the print window on the page.

In accordance with an important aspect of the present invention, to permit a high quality print image wherein each character is formed from a large number of pixels, without requiring excessive RAM for the image buffer, printing commences before all the characters in the print window have been converted into bit image data in the image buffer. The image buffer is thus implemented as a circular buffer, with pointers identifying its beginning prior to which data has already been extracted and printed and its end (beyond which, no new data is present). The buffer can accommodate a bit-mapped image 120 bits high (the number of electrodes in the printhead) and 1.4" (36 mm) wide. As shown symbolically in the state diagram of FIG. 4 by the dashed line connection between blocks, and in more detail in FIG. 8, concurrent with the image composition process 120, the engine responds to a print interrupt each time the printhead carriage 50 reaches the next pixel position in the printline. Driver data for all 120 electrodes is output from the image buffer, passing on the pixel data 108 for the current print position to the printhead driver circuitry 56 via a Direct Memory Access ("DMA") channel and thence to the individual electrodes on the printhead 44 whereupon the start pointer of the buffer is updated so that the memory space can be used for new image data further in the same line.

It should be noted that the printing process contemplated herein, in contrast to that employed in a conventional serial impact or thermal matrix printer, is a variable speed process which permits throughput to be maximized consistent with the available processing resources. Accordingly, prior to concluding the interrupt, the speed control data to the driver circuit for the motor which drives the carriage and the printhead is updated, in accordance with the distance from the column being printed to the left edge column position of the character being imaged in the image buffer.

As indicated in block 124, once the end of the current printline has been reached, and there is no more data in the Image Window List to be imaged, engine microprocessor 116 controls the raising of the printhead away from contact with the ribbon (thereby preventing ribbon wastage and unwanted drag between the printhead and the ribbon and between the ribbon and the paper) during carriage braking and when the paper is advancing, when the carriage is in carriage return mode and returning to the next start of printing position slightly in advance of the next print position (normally performed concurrently with a paper advance operation), or when the carriage is in tabular mode and skewing forward at high speed independently of the ribbon towards the next print position (thereby also conserving ribbon).

3.4. User Interface

In an exemplary preferred embodiment, the interface microprocessor 112 can also control communication with a user control panel CP which includes an alphanumeric LCD display 4 for displaying configuration and status information to the user, based upon control data from the host 100, and, via engine microprocessor 116, status information from various sensors (not shown) which determine critical conditions such as out-of-paper, out-of-ribbon, broken ribbon, and paper jam.

4. Symbolic Window Formatting

Figure 5:
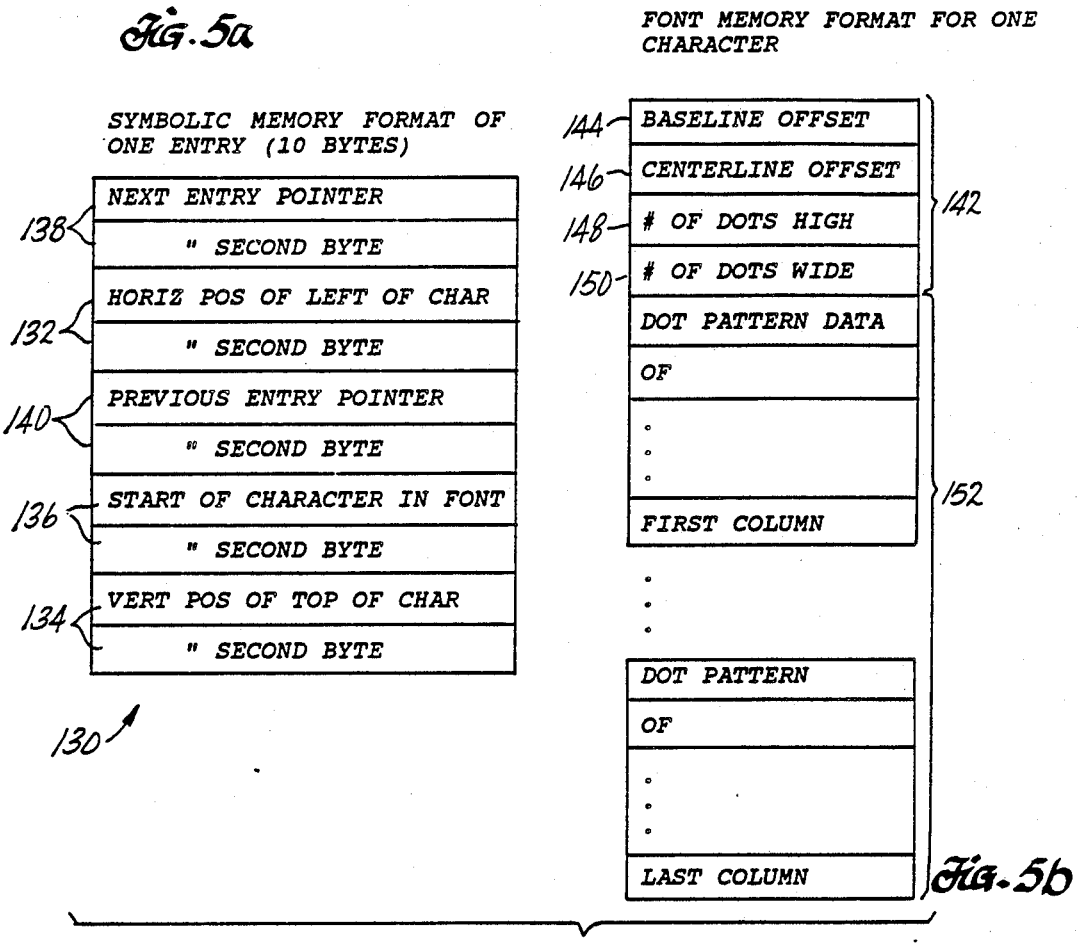
FIG. 5 comprising
Figure 6:
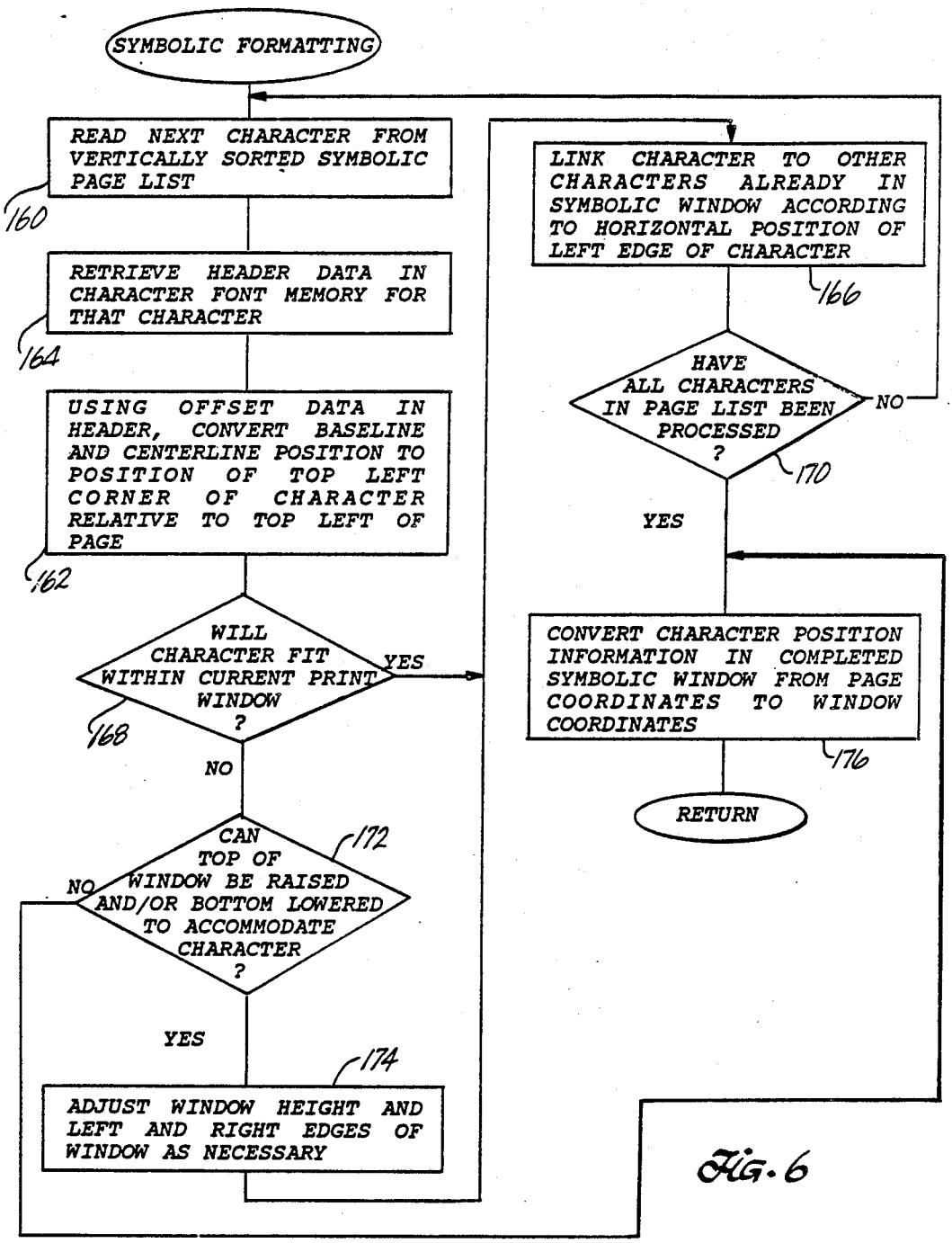
FIG. 6 is a flow chart diagram showing the processing steps used to convert conventional page oriented symbolic data into window oriented symbolic data in the form of a symbolic window list.

Reference should now be made to the flowchart of FIG. 6 and the data structure diagram of FIG. 5, comprising FIG. 5*a* and FIG. 5*b*.

Each entry 130 FIG. 5(*a*) corresponding to a single character in the symbolic window list includes header data specifying the horizontal position of the "left" edge of the character relative to the leftmost printable position (in pixels) 132; the vertical position of the top of the character (with respect to the top of the page) 134; the location of the character information in the font data 136; it may also include data relating to any special print modes (e.g., doublewide). The data for each character in the symbolic Window Buffer is linked to the next and previous characters (in order of horizontal position) by a next entry pointer 138 (which preferably points to the third byte (horizontal position 132) of the next entry in the horizontally linked symbolic window list. In order to facilitate inserting subsequent entries, there is also provided a previous entry pointer 140. The font data header (FIG. 4*b*) 142 includes a baseline offset 144, a centerline offset 146, height and width data (in pixels) 148, 150, and the pixel pattern 152 defining the character. The offset data 144, 146 is relative to a reference point defined for each character and which typically corresponds to a "crosshair" position on the current character line about which the character would be centered horizontally; in the absence of inter-character microspacing, the reciprocal of the horizontal distance between two successive such crosshair positions is the character pitch.

Thus, as shown in the symbolic formatting flowchart of FIG. 6, in order to form the horizontally ordered Symbolic Window List 106 from the vertically ordered Symbolic Page List 104, the character position data is sequentially converted by microprocessor 116 from crosshair position to start of character (i.e., top left corner) position (block 160) starting with the first unconverted character in the vertically sorted list (block 162) using the corresponding header data 142 for that character (block 164) and linked to the other characters in the symbolic window list 106 by horizontal position of the character's left edge (block 166) until either a first out-of-range character (possibly a paper feed command) is reached (test 168) that is outside a maximum print window having a height corresponding to the 120 electrodes on the printhead or the last character has been so converted (test 170). If necessary, the current window height may be increased up to the maximum determined by the height of the electrode array (test 172). In the exemplary embodiment being described herein, the upper left corner position of the window is initially set at the upper left corner of the first character in the list, the corner of the window is then moved up or to the left (block 174) as additional characters are added to the window list which are higher or to the left of the current corner position.

Having thus completed a symbolic window buffer in which the vertical coordinates are relative to the top of the page, the vertical coordinates are then preferably converted into a coordinate system more convenient for use in the subsequent Image Composition process (block 176). Preferably, this new coordinate system is correlated to the electrodes on the printhead. The Symbolic Window List with the vertical coordinates so adjusted will hereinafter be referred to as the "Symbolic Image".

It has been found that in an electrode assembly having a large number of electrodes that may be used to print more than one line of characters, non-uniform erosion effects occur as current flows through the different electrodes used to print the individual dots comprising the various characters. Thus, in accordance with yet another aspect of the invention, whenever a print window list to be printed in a particular printing pass does not contain any characters that extend to the very bottom of the window, and thus it will not be necessary to use both the uppermost and lowermost electrodes on the printhead during the next printing pass, the vertical position of the printhead relative to the upper corner of the print window is varied to more evenly distribute the erosion effects. This may be advantageously accomplished as part of the conversion of the Symbolic Window List to the Symbolic Image list (block 176).

In particular, if a completed symbolic window list does not occupy the full window height, a second test is made to determine whether at least one empty character line (40 pixels) is available at the bottom of the current print window. If so, the image is shifted to the center of the print window alternately offset by a predetermined amount (e.g., 5 pixels); if the image height differs from the window height by less than one line, the image is alternately shifted to the extreme top or bottom of the window. This has been found to distribute head wear more evenly among the electrodes for the normal printing situation in which otherwise (because of double and triple spaced printing) the middle line at the center of the head receives the least usage. However, an even more randomized utilization of the different areas of the head could possibly result in even more uniform wear.

It is to be noted that, if the electrode array on the printhead (and thus maximum print window height) is at least three times the maximum height of a standard sized character, the above-described symbolic window algorithm will accommodate characters up to three times standard size. Thus, when a triple height character having a baseline within the window is encountered, either it will already be within the existing window, or the one or both boundaries of the window can be adjusted until it does fit, or the current window is considered filled, and a new window started with the triple height character in question just below and to the right of the new window's upper left corner. However, although a triple height character is thus easily implemented, it has been found that when using the resistive ribbon thermal transfer process with a three line printhead having 120 electrodes arranged in a vertical ½" (13 mm) array, it is preferable that no more than 80 of the 120 electrodes should be used within close horizontal proximity of each other, in order to prevent severe weakening of the ribbon which could result in ribbon breakage as the spent ribbon is being wound onto the takeup reel. Thus, it is preferred that the maximum font size be not more than two thirds the vertical dimension from the uppermost electrode to the lowermost electrode in the array, which equates to about 24 points in typographic units and which is more than adequate for normal correspondence and desktop publishing applications. In any event, larger font sizes can easily be accommodated by including a capability to print bit-mapped graphics data composed in the host computer, as is done in conventional single line matrix printers, and using not more than two thirds or one half of the electrodes in any one pass when in graphics mode.

Furthermore, as noted above, it is preferable that no more than 80 pixels be activated within a predetermined horizontal increment. Thus it may be advantageous to include an additional test in the above-described symbolic window list generation process to measure the total height of all characters at a given horizontal position, and terminate the process as soon as the cumulative character height at any given position exceeds 80 pixels.

5. Bit-Mapped Image Composition

Assuming that the symbolic data has thus been formatted corresponding to a "print window" of horizontally ordered characters each having a specified vertical relationship relative to the uppermost electrode on the printhead, reference should now be made to FIG. 7, which is a functional flow diagram of the image composition process.

It should be noted that the individual characters are imaged in the same horizontally sorted order they appear in the symbolic window and thus the first step in the reiterative image composition process is to fetch width and height data for the current character (block 180) and determine if sufficient space is present in the Image Buffer to encompass the next character to be imaged (test 182). This is necessary because the Image Buffer is a circular buffer having only sufficient capacity to hold 512 successive pixel columns (about 1.4" (36 mm)) of bit-mapped image for each of the 120 head electrodes, for a total capacity of $120 \times 512 = 61{,}440$ bits (7,680 bytes); thus after the first 1.4" (36 mm) of the print window has been imaged, further imaging must wait until the beginning portion of the print window has already been printed. This test may simply be to determine if the end of the circular buffer is to the right of the beginning of the current character specified in the symbolic list (contained in the symbolic window list) by a distance at least equal to the width of the character to be imaged (also contained in the symbolic window list). If the test is negative, a wait loop 184 ensues; otherwise, the beginning location in the image buffer is identified (block 186), the appropriate offset from the beginning (top) of the character data to the boundary immediately above the character in the image memory is output to a hardware barrel shifter (block 188), and using the starting location of the character data and the height and width of the character (block 190), height and width counters are initialized (block 192). The first column of character pixels is ORed into the identified beginning column of the image buffer starting at the byte containing the identified beginning row (block 194) via the previously initialized hardware barrel shifter (block 188). By so utilizing a hardware barrel shifter between the font memory 114 and the accumulator register of the engine microprocessor 116, the proper offset of bit 0 of the character with respect to bit 0 of the window can easily be maintained without using additional processor cycles. Once the first byte of the first column of character pixel information has been so ORed, the height counter is decremented (block 196) and the process repeated (loop 198) to fill in the subsequent bytes of that column (test 200). This whole process is continued (resetting the height counter and decrementing a width counter (block 202) until the entire character has been inserted into the image buffer (YES branch of test 204). A test 206 is then made to determine if the entire window has been imaged. If not (NO branch 208) any subsequent characters are processed in the same manner.

Since the character data in the symbolic text window is already sorted by the horizontal position of the leftmost edge of each character, all of the bit-mapped image data in the image buffer to the left of the left edge of the character presently being processed is available for immediate printing. In practice, it is preferable to not start printing until either the image buffer is filled or the print data is exhausted, so that there will be sufficient image data available to permit a continuous motion of the printhead; otherwise it may be necessary to stop the printhead until additional image is ready for printing and then back up and re-accelerate for printing.

6. Output of Image to Printer

Conventional serial printers employ a fixed printhead velocity (multi-mode printers may have several such velocities—one for each mode); this simplifies the power requirements, mechanical design (simple stepper motors can be used and there is no need to compensate for the effects of acceleration or deceleration on the drive train) and also the firmware (in most printing technologies, including impact and ink jet, there is a noticeable lag between activation of a print element and the formation of the image on the paper). Since the prior art fixed velocity printers utilized processing hardware capable of handling the maximum possible data while printing at the nominal velocity, the hardware was not used at maximum efficiency and for a single line serial printer, there is only a relatively small penalty to pay in efficiency—perhaps 20%. However, if a head capable of printing as many as three lines of normal sized print is used to print triple spaced material, the 80% efficiency of a typical prior art fixed printhead velocity system will then be further reduced by a factor of three to only 24%. The situation is further compounded by the desirability, because of the relatively high cost of resistive thermal transfer printer ribbon, to avoid the need for double pass printing.

Thus, if the above described three-line printhead were to be used with an otherwise conventional constant velocity printer architecture, one possibility to obtain acceptable throughput would be to always print at the maximum printhead velocity and to compose all the image prior to commencing printing. With a letter quality resolution of 240×360 pixels per square inch, this would require an image buffer having in excess of 8 million bits for a full standard size page of image (8.5"×11" or 216×279 mm). Even if the image buffer memory were limited to a ½" (13 mm) wide strip being printed in a single 11" (279 mm) pass of the ribbon, this would require slightly less than 0.5 million bits. Alternatively, it would be possible to provide processing hardware capable of handling the maximum possible data rate and complexity while moving the printhead at its constant nominal velocity, with the result that the processing hardware requirements, and hence the costs could be several times what would otherwise be required. In either case, the power supply would have to be capable of supplying full voltage to all 120 electrodes of the printhead (80 electrodes, if the software checks for character combinations that could result in ribbon breakage).

In contrast, an 8085 microprocessor operating at a 10 MHz clock rate used in a printer having a printhead moving at a variable speed as contemplated herein has been found to have sufficient processing capability to process the image window from the vertical lists of character data (each with character font address, vertical position and horizontal position) and convert it into image data (240×360 pixels per square inch) at a maximum instantaneous rate of 500 standard size simple characters per second (maximum character cell size 40×36 pixels), or to output the image data to the printhead drive circuitry (including interrupt processing overhead) at an approximately equivalent rate (500×40×36 pixels per second); the exemplary printer P is accordingly able to compose bit mapped image and print it at a rated effective average print speed of 240 10-pitch characters per second in three line (single spaced) mode, using a head speed of 8 ips. In the event the character spacing is increased, its head speed will be adaptively increased up to a maximum speed consistent with quiet, reliable operation (about 12 ips in the exemplary embodiment) which will still permit an effective print speed of 120 cps for triple spaced 10 pitch characters. Since the demand on the power supply for the current consumed during printing is roughly proportional to effective printing rate and to the square root of printhead velocity, a power supply capable of printing 240 characters per second (cps) at 6 ips (152 mm/sec) should be able to print up to $240 \cdot \sqrt{\frac{1}{2}} = 170$ cps at twice that speed. Thus, the capacity exists to increase the printhead velocity whenever the character density drops, without providing either excessive RAM or excessive processing capability. Conversely, if the image complexity is increased (e.g., by overstrikes) the printhead speed will be reduced to match the processing throughput of the printer engine microprocessor which provides the pixel data to the printhead drivers, again without providing either excessive RAM or excessive processing capability. Deviations from normal printing can be readily accommodated by a temporary change in the printhead velocity, based on the amount of unprinted image data remaining in the image buffer; the processor can establish the optimal speed and applicable deceleration/acceleration profile from a simple digital filter algorithm possibly supplemented by a look-up table.

6.1. Digital Print Speed Algorithm

It has been found that the thermal transfer resistive ribbon printing process functions best between 6 ips and 12 ips (152 mm to 305 mm/sec); however, excessive acceleration and deceleration (i.e., above 60"/sec$^2$ (152 cm/sec)) within that preferred velocity range is undesirable. Not only will the high forces resulting from extreme changes in carriage velocity cause the drive belt between the carriage motor M and the carriage 50 to stretch so that the position encoder E on the motor M will not accurately reflect the position of the carriage and will result in poor horizontal registration, such excessive forces will produce audible and undesirable noise.

Finally it should be noted that whenever the carriage velocity falls below 6 ips (152 mm/sec), provision should be made to automatically decelerate to a complete stop, lift the printhead and reposition the printhead a sufficient distance in advance of the next printing position to provide a smooth acceleration to operating velocity. Since ribbon motion is normally synchronized with forward printhead motion (in order to keep the relative motion of the ribbon and the print carrier within the desired limits), this can result in additional expenditure of both time and ribbon. However, there are times, for example, when printing tabular data, when it is desirable in the interests of conserving ribbon and/or increasing throughput, to intentionally terminate the current printing operation, lift the printhead, disengage the ribbon advance mechanism, and tabulating the carriage at high speed to a position just prior to the next column position where characters are to be printed. In the presently preferred embodiment described herein, provision has thus been made for two "tabulator" modes—a maximum throughput mode which is activated only when a minimum of one inch (25 mm) of blank column postions are encountered in the image buffer, and a maximum ribbon saving mode which is activated whenever all columns of 3 adjacent character positions (0.3"=7.5 mm) are blank.

Bearing the above considerations in mind, reference should now be made to in FIG. 8. The engine microprocessor 116 not only accesses the IMAGE BUFFER containing the digital image data 108 from which it obtains the 120 bit column of data which is output on the DMA channel to the driver board 56 in response to the interrupt which is generated as the carriage 50 reaches the next pixel column in the print window (block 220), but it also updates a set of IMAGE BUFFER STATUS REGISTERS which contain the input and output pointers to the current input and output locations of the IMAGE BUFFER (implemented as a circular, first in first out store) as well as a VALID IMAGE COUNT (which in effect measures how far the printhead may travel without running out of data by subtracting the output pointer from the input pointer thereby determining how much of the IMAGE BUFFER has been filled with valid, unprinted image data) (block 222). In addition, it maintains a SPEED CONTROL COUNT that follows the current VALID IMAGE COUNT except that it is constrained by a maximum rate of increment (block 224). Such a constrained count is necessary because a large horizontal space (which requires essentially no time for image composition) may exist between two adjacent characters in the image window list, the resultant abrupt movement of the input pointer (and the corresponding abrupt increase in the IMAGE BUFFER COUNT) should not be permitted to result in an abrupt increase in printhead velocity. On the other hand, the output pointer will move only in response to movement of the printhead and thus is already constrained by the inertia of the mechanism and will not cause any abrupt change in the IMAGE BUFFER COUNT. The speed control count is then converted (using a simple table lookup scheme) into a digital word representing the desired printhead velocity SPEED CONTROL which is output to a conventional dc speed control servo circuit 246 driving the carriage motor M (block 226—see also FIG. 9). The desired speed is thus determined by the lesser of the current valid image count and a corresponding simple ramp function (the speed control count) which establishes the maximum permissible acceleration from the previously specified desired speed.

6.2. Control of Other Print Process Parameters

Also critical to the printing process is the requirement that appropriate modifications be made in realtime to the other process parameters is response to changes in printhead velocity. Without such realtime modification of process parameters, it would not be possible to maintain the consistent high print quality and accurate registration that is possible with a resistive ribbon thermal transfer printer using a fixed velocity printhead.

Figure 9:
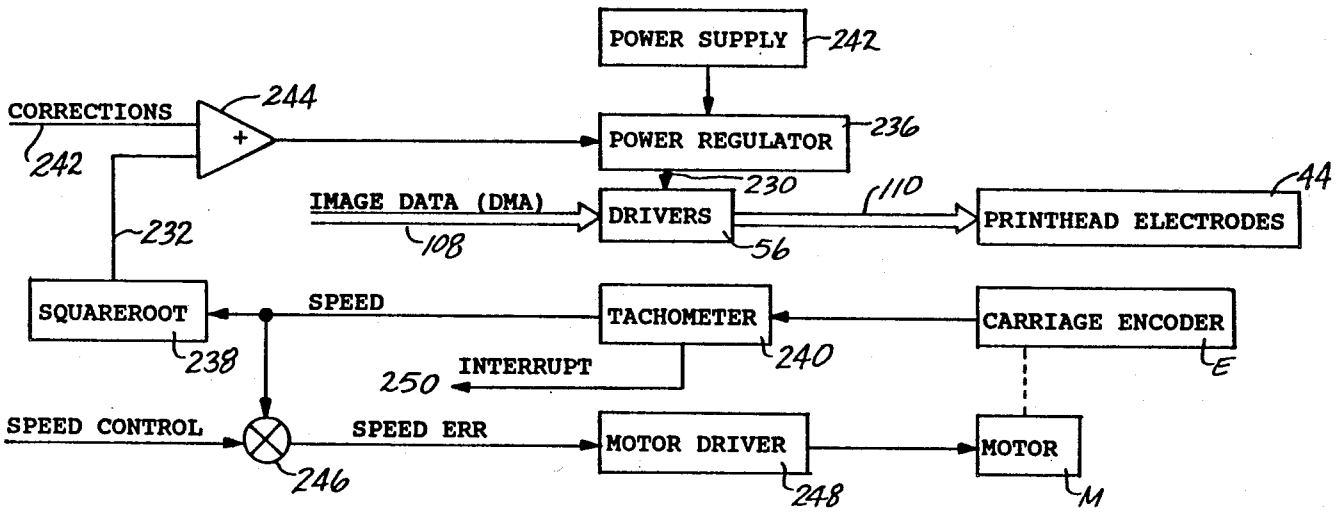
FIG. 9 is a process control diagram showing the flow of control data for maintaining optimum efficiency and quality.

Reference should now be made to FIG. 9, which shows the analog circuitry used to the motor speed and the power to the print elements. The basic principle to be implemented in the printhead voltage control circuit is that the amount of energy to print one pixel is essentially constant over the range of print speed contemplated—6 ips to 12 ips (152 to 305 mm/sec) printhead velocity. Since the effective resistance remains constant, the energy per unit time will vary as the square of the voltage applied to the printhead. On the other hand, the time available to print a single pixel will vary inversely with the printhead velocity. Thus, the voltage to the printhead driver circuit 56 (or the current flowing from one activated electrode in the printhead) 230 is varied in proportion to the squareroot 232 of the printhead velocity 234. This is readily implemented using a variable regulated power supply 236 to provide the power to the printhead driver circuit 56. The required adaptive control can take the form of an analog square root circuit 238 responsive to the analog velocity signal 234 from an analog tachometer circuit 240 which in turn is responsive to an ENCODER signal from a conventional encoder E coupled to the carriage motor M (see FIG. 9). In an alternative embodiment it can assume the form of a simple table lookup scheme in which the input is the previously determined printhead velocity command and the output is a digital word used to control the power supply (directly, or by means of an analog-to-digital converter).

It is also preferable that the voltage drop across the ground return path portion of the ribbon's conductive layer from the printhead to the ground electrode be monitored and appropriate feedback 242 is provided which interacts with the square root signal 232 in an operational amplifier 244 to ensure a constant voltage across the resistive layer, in a manner similar to that described in the above noted prior art. It is also preferable that equal series bias resistances (not shown) be included in the current path from the individual electrode drivers to the corresponding electrodes, to compensate for variations in the contact resistance of different individual electrodes by reducing the voltage between the head and ground when the current flow is abnormally high.

Of course, the power supply 242 must be able to provide the required power throughout the anticipated speed range. This condition is satisfied for the exemplary system described in detail herein when printing standard character oriented text; moreover, in any practical system, some short-term surge capability is inherent in the filter capacitors normally associated with the power supply, and the above-described image processing algorithms are to some extent inherently self-limiting in terms of power requirements since they will process dense normal text (which will have less white space and thus require more power to print more black pixels) more slowly than text having a few widely spaced characters. However, for applications permitting densely filled in graphics characters or for a system where reverse contrast printing (white characters on a black ground) is desired, consideration should be given to providing a power supply having a sufficient capacity to drive the maximum number of electrodes permitted with the maximum current required for the maximum print velocity. Alternately, a simple algorithm could be used to count the number of black pixels (logical "1"s in the present embodiment) and use such a count as a further constraint on the speed control count, so that the printhead velocity also depends on the anticipated demand for power to heat the portions of the ribbon corresponding to black pixels.

Referring once again to FIG. 9, it will be understood that the commanded speed output by the engine microprocessor (FIG. 8) is converted to an analog signal by a digital to analog converter (not shown). The resultant SPEED CONTROL signal is compared with the measured SPEED in a subtracter 246. The SPEED ERR thus generated is input to the motor driver circuit 248. The same conventional tachometer circuit which generates the analog SPEED signal 234 may also be used to generate the digital interrupts 250 each time the carriage advances one pixel position (1/360 inch or 0.07 mm).

7. Conclusion

The present invention has been described above with regard to the structure, function and use of a presently contemplated specific embodiment of the invention. It should be appreciated by those skilled in the art that many modifications and variations are possible. Accordingly the exclusive rights afforded hereby should be broadly construed, limited only by the spirit and scope of the appended claims.

What is claimed is:

1. A method for printing character oriented data comprising the steps:

first processing data representative of a plurality of printed characters and their relative locations with respect to a page to be printed into a first list sorted by the vertical distance from a baseline point of each particular character to the top of the page, said first list including a first character and a last character then sequentially converting the data in said first list starting with said first character into a second list of characters sorted by the horizontal distance from a particular character to a specified edge of the page until either a first out-of-range character is reached in said second list that does not fall within a current print window having a predetermined window height at least three times the height of said printed characters, but less than the height of said page, or said last character has been so converted then sequentially printing the characters in said second list, then reinitializing said second list then continuing to convert the characters in said first list into characters in the reinitialized second list, until either a second out-of-range character is reached in said first list that does not fall within said print window, or said last character has been so converted then sequentially printing the characters in said reinitialized second list.

2. The method of claim 1 wherein the first character converted in said continuing step starts with said first out-of-range character.

3. A method for printing character oriented data comprising the steps:

first processing data representative of a plurality of printed characters and their relative locations with respect to a page to be printed into a first list sorted by the vertical distance from a baseline point of each particular character to the top of the page, said first list including a first character and a last character then sequentially converting the data in said first list starting with said first character into a second list of characters sorted by the horizontal distance from a particular character to a specified edge of the page until either a first out-of-range character is reached in said second list that does not fall within a current print window having a predetermined window height at least three times the height of said printed characters, but less than the height of said page, or said last character has been so converted then sequentially printing the characters in said second list creating another list of characters sorted by the horizontal distance from a particular character to a specified edge of the page then, prior to the completion of printing the characters in said second list, continuing to convert the characters in said first list into characters in the newly created said another list until either a second out-of-range character is reached in said first list that does not fall within a corresponding another print window also having said predetermined window height, or said list character has been so converted then sequentially printing the characters in said another list.

4. The method of claim 3, wherein the first character converted in said continuing step starts with said first out-of-range character.

* * * * *